United States Patent [19]

Vervacke et al.

[11] Patent Number: 4,820,683

[45] Date of Patent: Apr. 11, 1989

[54] THERMALLY-RESPONSIVE RECORD MATERIAL

[75] Inventors: Steven L. Vervacke; Kenneth D. Glanz, both of Appleton, Wis.

[73] Assignee: Appleton Papers Inc., Appleton, Wis.

[21] Appl. No.: 128,857

[22] Filed: Dec. 4, 1987

[51] Int. Cl.[4] ..... B41M 5/18

[52] U.S. Cl. ..... 503/210; 427/150; 427/151; 428/913; 503/208; 503/209; 503/211; 503/212; 503/216; 503/217; 503/225

[58] Field of Search ..... 427/150–152; 428/913, 914; 503/208, 209, 216, 217, 225, 210–212

[56] References Cited

U.S. PATENT DOCUMENTS

| | | | |
|---|---|---|---|
| 2,691,039 | 10/1954 | Linsert . | |
| 2,802,869 | 8/1957 | Montgomery . | |
| 2,865,956 | 12/1958 | Rhuddlan et al. . | |
| 2,969,389 | 1/1961 | Kundiger et al. . | |
| 3,345,263 | 10/1967 | Subbaratnam . | |
| 3,396,193 | 8/1968 | Freedman et al. . | |
| 3,497,501 | 2/1970 | Caldwell et al. . | |
| 3,591,623 | 7/1971 | Back et al. . | |
| 3,723,489 | 3/1973 | Dexter et al. . | |
| 3,874,895 | 4/1975 | Hayashi et al. | 503/216 |
| 4,060,535 | 11/1977 | Cinco . | |
| 4,720,301 | 1/1988 | Kito et al. | 503/217 |
| 4,732,810 | 3/1988 | Kito et al. | 503/208 |

FOREIGN PATENT DOCUMENTS

| | | | |
|---|---|---|---|
| 0244595 | 12/1985 | Japan | 503/208 |
| 0160288 | 7/1986 | Japan | 503/209 |

*Primary Examiner*—Bruce H. Hess

*Attorney, Agent, or Firm*—Benjamin Mieliulis

[57] ABSTRACT

An improved thermally-responsive record material having improved image retention is disclosed. The invention is an improved thermally-responsive record member, typically a sheet material, bearing a thermally-responsive color-forming composition comprising a chromogenic material, an acidic developer material, and a metal salt of a compound of the formula

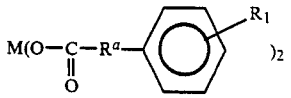

wherein $R^a$ is selected from —CH=CH,

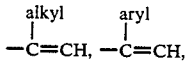

—$(CH_2)_4$—, —$(CH_2)_3$—, —$(CH_2)_3$—, —$CH_2$—CH=CH—, and —$CH_2$—wherein $R_1$ is selected from hydrogen, halogen, alkyl, oxyalkyl, or $NO_2$ with the proviso that the alkyl groups are of 1–5 carbons wherein M is a metal selected from Zn, Ca, Sn, Ni, Cu, Al, Co, and Mg.

11 Claims, No Drawings

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material and acidic color developer material. This invention particularly concerns a thermally-responsive record material capable of forming an image resistant to fade or erasure. The invention teaches a record material having improved image retention density.

2. Description of Related Art

Thermally-responsive record material systems are well known in the art and are described in many patents, for example, U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a colored image of sufficient intensity upon selective thermal exposure.

A drawback of thermally-responsive record materials limiting utilization in certain environments and applications has been the undesirable tendency of thermally-responsive record materials upon forming an image to not retain that image in its original integrity over time when the thermally-responsive record material is handled or exposed to common liquids or oils or plasticizers such as found in skin oil, plastic food wrap, cooking oil and common carbonless paper solvents. As a result, a high degree of care and control in handling imaged thermally-responsive record materials has been required. This loss of image density and fade can be not only annoying but potentially damaging commercially whenever the integrity of records is allowed to become suspect through improper record storage.

The ability of a thermally-responsive record material to resist image fading or erasure upon contact with common oils, solvents or plasticizers would be an advance in the art and of commercial significance.

It is an object of the present invention to disclose a thermally-responsive record material having improved image retention and resistance to fade or erasure. The record material of the invention is remarkably resistant to fade or erasure when contacted with common oils, such as skin oil, internal phase or carbonless solvents, or plasticizers.

It is an object of the present invention to disclose a thermally-responsive recording material having an improved thermal response.

It is an object of the present invention to disclose a thermally-responsive record material comprising a support member bearing a thermally-sensitive color forming composition comprising chromogenic material and acidic developer material in contiguous relationship, whereby the melting or sublimation of either material produces a change in color by reaction between the two, a metal salt of a cinnamic acid, and a suitable binder therefor.

SUMMARY OF THE INVENTION

The present invention is an improved thermally-responsive record material having improved image retention. The invention is an improved thermally-responsive record member typically a sheet material, bearing a thermally-responsive color-forming composition comprising a chromogenic material, an acidic developer material, and a metal salt of a compound of the formula

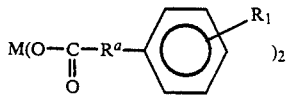

(I)

wherein $R^a$ is selected from —CH=CH—,

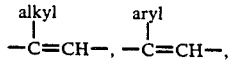

—$(CH_2)_4$—, —$(CH_2)_3$—, —$(CH_2)_2$—, —$CH_2$—CH=CH—, and —$CH_2$— wherein $R_1$ is selected from hydrogen, halogen, alkyl, oxyalkyl, or $NO_2$ with the proviso that the alkyl groups are of 1–5 carbons wherein M is a metal selected from Zn, Ca, Sn, Ni, Cu, Al, Co, and Mg, preferably Zn and Ca.

More preferably the present invention is a novel thermally-responsive record material bearing a thermally-sensitive color-forming composition comprising a chromogenic material and an acidic developer material in contiguous relationship, whereby the melting or sublimation of either material produces a change in color by reaction between the two, a metal salt of a cinnamic acid of the formula

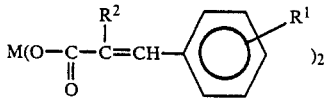

(II)

wherein M is a divalent metal selected from Zn, Ca, Sn, Ni, Cu, Al, Co and Mg, most preferably M is Zn or Ca; wherein $R^1$ is selected from hydrogen, halogen, alkyl, oxyalkyl, $NO_2$, wherein $R^2$ is selected from hydrogen, alkyl, or aromatic group, with the proviso that the $R^1$ and $R^2$ alkyl groups individually are of 1–5 carbons. Preferably, R is selected from hydrogen, chlorine, $CH_3$, $OCH_3$, and $NO_2$. A suitable binder for the above is also included.

The thermally-responsive record material of the invention has the unexpected and remarkable properties of being capable of forming a high density image upon selective thermal contact and of retaining that image over time when handled or exposed to common skin oils, internal phase or carbonless solvents, and plasticizers. This remarkable ability of the metal salts of cinnamic acids to impart fade and erasure resistance to thermally-responsive record materials is a significant advance in the art.

DETAILED DESCRIPTION

Description of Preferred Embodiments

The present invention is a novel thermally-responsive record material bearing a thermally-sensitive color-forming composition comprising a chromogenic material and an acidic developer material in contiguous relationship, whereby the melting or sublimation of either material produces a change in color by reaction between the two, a metal salt of a cinnamic acid of the formula

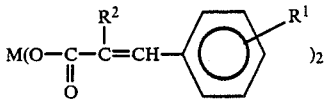

(II)

wherein M is a metal selected from Zn, Ca, Sn, Ni, Cu, Al, Co, and Mg, preferably M is Zn or Ca; wherein $R^1$ is selected from hydrogen, halogen, alkyl, oxyalkyl, $NO_2$, with the proviso that the alkyl groups are of 1–5 carbons, preferably, $R^1$ is selected from hydrogen, Cl, $CH_3$, $OCH_3$, and $NO_2$. $R^2$ is selected from hydrogen, alkyl or an aromatic group, with the proviso that the alkyl group is of 1–5 carbons a suitable binder for the above is also included.

Most preferred among the metallic salts of the cinnamic acids and cinnamic acid derivatives are di(3-phenyl-2-propenoate)zinc more commonly referred to as zinc(cinnamate)$_2$ or zinc cinnamate; zinc(2-chlorocinnamate)$_2$; zinc(3-chlorocinnamate)$_2$; zinc(4-chlorocinnamate)$_2$; zinc(2-methoxycinnamate)$_2$; zinc(3-methoxycinnamate)$_2$; zinc(4-methoxycinnamate)$_2$; zinc(3,4,5-trimethoxycinnamate)$_2$; zinc(4-methylcinnamate)$_2$; zinc(2-nitrocinnamate)$_2$; and zinc(3-nitrocinnamate)$_2$.

The metallic salts of cinnamic acid and its derivatives of Formulas I and II can be readily prepared either by dissolving the corresponding sodium salt in water, or, by dissolving the corresponding cinnamic acid or derivative in solvent, adding the metal salt such as zinc salt, followed by mild heating. The organometallic product is precipated from the solution.

Structurally related compounds surprisingly also proved useful for improved image retention, and include the metallic (M) salts (M as previously defined): metallic salt of phenyl butyrate, preferably zinc salt

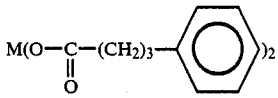

metallic salt of styrene acetic acid (also known as 4,4-phenylbutenoic acid), preferably zinc salt, i.e. zinc (styrlacetate)

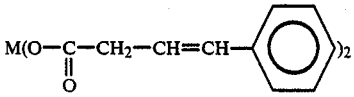

metallic salt of phenyl acetic acid, preferably zinc salt

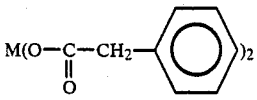

These compounds are to be understood as included also in the following discussion when referring to "a metallic salt of a cinnamic acid of formula I".

The invention comprises a thermally-sensitive color-forming composition comprising chromogenic material and acidic developer material, a metal salt of a cinnamic acid of formula I and binder material. The unexpected feature of this composition is that, the inclusion of the above metal salt of cinnamic acid of formula I with prior art thermally-sensitive color-forming compositions results in a composition possessing improved resistance to fade and image erasure.

Isomeric form was found not to diminish image retentiveness. In most cases the trans isomer was preferable. However, no case was identified wherein the cis isomer did not function effectively, thus the isomeric form did not appear itself determinative of effectiveness. While the trans form of the geometric isomer was somewhat preferred, nonetheless similarities in chemical properties of these diastereomers are encountered.

The color-forming composition (or system) of the record material of this invention comprises chromogenic material in its substantially colorless state and acidic developer material such as, for example, phenolic compounds. The metal salt of a cinnamic acid can itself be the developer material though this is not preferred. The color-forming system relies upon melting, softening, or subliming one or more of the components to achieve reactive, color-producing contact.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of this invention resides in the color-forming composition coated on the substrate. The kind or type of substrate material is not critical.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents; defoamers, sensitizers and antioxidants. Sensitizers, for example, can include acetoacet-o-toluidine, phenyl-1-hydroxy-2-naphthoate, 1,2-diphenoxyethane, and p-benzylbiphenyl.

The color-forming system components are substantially insoluble in the dispersion vehicle (preferably water) and are ground to an individual average particle size of between about 1 micron to about 10 microns, preferably about 1–3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the like.

Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binders should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds, for use in the color-forming system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di-[2H-1-benzopyran] and mixtures of any of the following.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid, m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl)pentanoate; methyl-4,4-bis(4-hydroxyphenyl)pentanoate; allyl-4,4-bis(4-hydroxyphenyl)pentanoate; 3,3-bis(4-hydroxyphenyl)-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, and benzyl-p-hydroxybenzoate. Acid compounds of other kind and types ae eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The milling was accomplished in an attritor or other suitable milling device. The desired average particle size was about 1–3 microns in each dispersion.

The thermally-responsive sheets were made by making separate dispersions of chromogenic material, acidic material and a metal salt of a cinnamic acid of formula I (also referred to as metal cinnamate). The dispersions were mixed in the desired ratios and applied to a support with a wire wound rod and dried. The metal cinnamate can be used as the sole acidic material with a chromogenic material to give a thermally-responsive sheet. Other materials such as sensitizers, fillers, antioxidants, lubricants and waxes can be added if desired. The sheets may be calendered to improve smoothness.

Preparation of Dispersion

| | | Parts |
|---|---|---|
| Dispersion A - Chromogenic Material (Small Media Mill) | | |
| Premix | Chromogenic Material | 39.10 |
| | Binder, 20% Solution of Polyvinyl Alcohol (Vinol 205) in Water | 28.12 |
| | Water | 45.00 |
| | Defoamer and Dispersing Agents | 0.28 |
| Then Add and Mill | Surfynol 104*, 5% Solution in Isopropyl Alcohol | 12.00 |

Dispersion A-1 - Chromogenic Material is N-102. 3-diethylamino-6-methyl-7-anilino fluoran.

Dispersion A-2 - Chromogenic Material is di-Butyl N-102,

-continued

Preparation of Dispersion

| | Parts |
|---|---|
| 3-dibutylamino-6-methyl-7-anilino fluoran. | |
| Dispersion A-3 - Chromogenic Material is PSD-150, 3-(N—cyclohexyl-N—methylamino)-6-methyl-7-anilino fluoran. | |
| Dispersion A-4 - Chromogenic Material is CF-51, 3-(N—ethyl-N—tetrahydrofurfurylamino)-6-methyl-7-anilino fluoran. | |
| Dispersion A-5 - Chromogenic Material is TH-107, 3-dibutylamino-7-(2-chloroanilino)fluoran. | |
| Dispersion A-6 - Chromogenic Material is CVL, 3,3-bis(4-dimethylaminophenyl)-6-dimethylaminophthalide. | |
| Dispersion A-7 - Chromogenic Material is PB-6, 7-(1-ethyl-2-methylindol-3-yl)-7-(4,diethylamino-2-ethoxy-phenyl)-5,7-dihydrofuro,[3,4-b]pyridine-5-one. | |
| Dispersion A-8 - Chromogenic Material is Octyl PB-6, 7-(1-octyl-2-methylindol-3-yl)-7-(4-diethylamino-2-ethoxy-phenyl)-5,7-dihydrofuro[3,4-b]pyridine-5-one. | |
| Dispersion A-9 - Chromogenic Material is Green 118, 3,5',6-tris(dimethylamino)Spiro[9H—fluorene-9,1'(3'H)—isobenzofuran]-3'-one. | |
| Dispersion B - Acidic Material | |
| (Small Media mill) | |
| Acidic Material | 127.63 |
| Binder, 20% Solution of Polyvinyl Alcohol (Vinol 205) in Water | 63.45 |
| Water | 108.24 |
| Defoamer, Nopco NDW* | 0.14 |
| Dispersing Aid, Surfynol 104* | 0.55 |
| Dispersion B-1 - Acidic Material is AP-5, 2,2-bis(4-hydroxylphenyl)-4-methylpentane. | |
| Dispersion B-2 - Acidic Material is Bisphenol A, 4,4'-isopropylidenediphenol. | |
| Dispersion B-3 - Acidic Material is TG-S, bis(3-allyl-4-hydroxyphenyl)sulfone. | |
| Dispersion B-4 - Acidic Material is Bz, benzyl-p-hydroxy benzoate. | |
| Dispersion C - Sensitizer Material | |
| (Small Media Mill) | |
| Sensitizer | 89.25 |
| Binder, 20% Solution of Polyvinyl Alcohol (Vinol 205) in Water | 76.13 |
| Water | 134.10 |
| Defoamer, Nopco NDW* | 0.11 |
| Dispersion Aid, Surfynol 104* | 0.42 |
| Dispersion C-1 - Sensitizer is DPE, 1,2-diphenoxyethyane. | |
| Dispersion C-2 - Sensitizer is AAOT, acetoacet-o-toluidine. | |
| Dispersion C-3 - Sensitizer is BBP, p-benzyl biphenyl. | |
| Dispersion C-4 - Sensitizer is PHNT, phenyl-1-hydroxy-2-naphthoate. | |
| Dispersion D - Metal Salt | |
| (Small Media Mill) | |
| Metal Salt | 13.60 |
| Binder, 20% Solution of Polyvinyl Alcohol (Vinol 205) in Water | 11.60 |
| Water | 54.72 |
| Defoamer, Nopco NDW* | 0.02 |
| Dispersing Aid, Surfynol 104* | 0.06 |
| Dispersion D-1 - Metal Salt is zinc(cinnamate)$_2$. | |
| Dispersion D-2 - Metal Salt is zinc(2-chlorocinnamate)$_2$. | |
| Dispersion D-3 - Metal Salt is zinc(3-chlorocinnamate)$_2$. | |
| Dispersion D-4 - Metal Salt is zinc(4-chlorocinnamate)$_2$. | |
| Dispersion D-5 - Metal Salt is zinc(2-methoxycinnamate)$_2$. | |
| Dispersion D-6 - Metal Salt is zinc(3-methoxycinnamate)$_2$. | |
| Dispersion D-7 - Metal Salt is zinc(4-methoxycinnamate)$_2$. | |
| Dispersion D-8 - Metal Salt is zinc(3,4,5-trimethoxycinnamate)$_2$. | |
| Dispersion D-9 - Metal Salt is zinc(4-methylcinnamate)$_2$. | |
| Dispersion D-10 - Metal Salt is zinc(2-nitrocinnamate)$_2$. | |
| Dispersion D-11 - Metal Salt is zinc(3-nitrocinnamate)$_2$. | |
| Dispersion D-12 - Metal Salt is zinc($\alpha$-phenylcinnamate)$_2$. | |
| Dispersion D-13 - Metal Salt is zinc($\alpha$-methylcinnamate)$_2$. | |
| Dispersion D-14 - Metal Salt is zinc(4-phenylbutyrate)$_2$. | |
| Dispersion D-15 - Metal Salt is zinc(styrlacetate)$_2$. | |
| Dispersion D-16 - Metal Salt is zinc(cis-o-methoxycinnamate)$_2$. | |
| Dispersion D-17 - Metal Salt is calcium(cinnamate)$_2$. | |
| Dispersion D-18 - Metal Salt is zinc(phenylacetate)$_2$. | |
| Dispersion D-19 - Metal Salt is zinc(hydrocinnamate)$_2$. | |
| Dispersion E - Metal Stearate | |

-continued

Preparation of Dispersion

| | Parts |
|---|---|
| (Attritor) | |
| Metal Stearate | 13.60 |
| Binder, 20% Solution of Polyvinyl Alcohol (Vinol 205) in Water | 11.60 |
| Water | 54.72 |
| Defoamer, Nopco NDW* | 0.02 |
| Dispersing Aid, Surfynol 104* | 0.06 |
| Dispersion E-1 - Metal Stearate is Zinc Stearate. | |
| Dispersion E-2 - Metal Stearate is Aluminum Stearate. | |
| Dispersion E-3 - Metal Stearate is Calcium Stearate. | |
| Dispersion E-4 - Metal Stearate is Barium Stearate. | |
| Dispersion E-5 - Metal Stearate is Magnesium Stearate. | |
| Dispersion E-6 - Metal Stearate is Lithium Stearate. | |
| The metal stearate function or lubricants Dispersion E-1 through E-6 exemplify the most commonly used lubricants. | |

*(Nopco NDW is a sulfonated castor oil produced by Nopco Chemical Company. Surfynol 104 is a di-tertiary acetylene glycol surface active agent produced by Air Products and Chemicals, Inc.)

Test Formulations

| | Parts |
|---|---|
| Control-1 | |
| Dispersion A-1 | 0.95 |
| Dispersion B-1 | 2.35 |
| Dispersion C-1 | 3.36 |
| Filler | 1.40 |
| Dispersion E-1 | 1.76 |
| PVA (10% Solution Vinol 325 in Water) | 6.30 |
| Water | 8.88 |
| Control-2 - Same as Control-1 but use Dispersion A-2 in place of Dispersion A-1. | |
| Control-3 - Same as Control-1 but use Dispersion A-3 in place of Dispersion A-1. | |
| Control-4 - Same as Control-1 but use Dispersion A-4 in place of Dispersion A-1. | |
| Control-5 - Same as Control-1 but use Dispersion A-5 in place of Dispersion A-1. | |
| Control-6 - Same as Control-1 but use Dispersion A-6 in place of Dispersion A-1. | |
| Control-7 - Same as Control-1 but use Dispersion A-7 in place of Dispersion A-1. | |
| Control-8 - Same as Control-1 but use Dispersion A-8 in place of Dispersion A-1. | |
| Control-9 - Same as Control-1 but use Dispersion A-9 in place of Dispersion A-1. | |
| Control-10 - Same as Control-1 but use Dispersion C-2 in place of Dispersion C-1. | |
| Control-11 - Same as Control-1 but use Dispersion C-3 in place of Dispersion C-1. | |
| Control-12 - Same as Control-1 but use Dispersion C-4 in place of Dispersion C-1. | |
| Control-13 - Same as Control-1 but use Dispersion B-2 in place of Dispersion B-1. | |
| Control-14 - Same as Control-1 but use Dispersion B-3 in place of Dispersion B-1. | |
| Control-15 - Same as Control-1 but use Dispersion B-4 in place of Dispersion B-1. | |
| Example 1-1 | |
| Dispersion A-1 | 0.57 |
| Dispersion D-1 | 3.53 |
| Dispersion C-1 | 2.01 |
| Filler | 0.84 |
| Dispersion E-1 | 1.06 |
| PVA (10% Solution Vinol 325 in Water) | 3.78 |
| Water | 3.28 |
| Example 1-2 | |
| Dispersion A-1 | 0.57 |
| Dispersion B-1 | 0.71 |
| Dispersion D-1 | 1.76 |
| Dispersion C-1 | 2.02 |
| Filler | 0.84 |
| Dispersion E-1 | 1.06 |
| PVA (10% Solution Vinol 325 in Water) | 3.54 |
| Water | 4.50 |
| Example 1-3 - Same as Example 1-2 but using Dispersion D-2 in | |

-continued

Test Formulations

| | Parts |
|---|---|
| place of Dispersion D-1. | |
| Example 1-4 - Same as Example 1-2 but using Dispersion D-3 in place of Dispersion D-1. | |
| Example 1-5 - Same as Example 1-2 but using Dispersion D-4 in place of Dispersion D-1. | |
| Example 1-6 - Same as Example 1-2 but using Dispersion D-5 in place of Dispersion D-1. | |
| Example 1-7 - Same as Example 1-2 but using Dispersion D-6 in place of Dispersion D-1. | |
| Example 1-8 - Same as Example 1-2 but using Dispersion D-7 in place of Dispersion D-1. | |
| Example 1-9 - Same as Example 1-2 but using Dispersion D-8 in place of Dispersion D-1. | |
| Example 1-10 - Same as Example 1-2 but using Dispersion D-9 in place of Dispersion D-1. | |
| Example 1-11 - Same as Example 1-2 but using Dispersion D-10 in place of Dispersion D-1. | |
| Example 1-12 - Same as Example 1-2 but using Dispersion D-11 in place of Dispersion D-1. | |
| Example 1-13 - Same as Example 1-2 but using Dispersion E-2 in place of Dispersion E-1. | |
| Example 1-14 - Same as Example 1-2 but using Dispersion E-3 in place of Dispersion E-1. | |
| Example 1-15 - Same as Example 1-2 but using Dispersion E-4 in place of Dispersion E-1. | |
| Example 1-16 - Same as Example 1-2 but using Dispersion E-5 in place of Dispersion E-1. | |
| Example 1-17 - Same as Example 1-2 but using Dispersion E-6 in place of Dispersion E-1. | |
| Example 1-18 - Same as Example 1-2 but using Dispersion D-12 in place of Dispersion D-1. | |
| Example 1-19 - Same as Example 1-2 but using Dispersion D-13 in place of Dispersion D-1. | |
| Example 1-20 - Same as Example 1-2 but using Dispersion D-14 in place of Dispersion D-1. | |
| Example 1-21 - Same as Example 1-2 but using Dispersion D-15 in place of Dispersion D-1. | |
| Example 1-22 - Same as Example 1-2 but using Dispersion D-16 in place of Dispersion D-1. | |
| Example 1-23 - Same as Example 1-2 but using Dispersion D-17 in place of Dispersion D-1. | |
| Example 1-24 - Same as Example 1-2 but using Dispersion D-18 in place of Dispersion D-1. | |
| Example 1-25 - Same as Example 1-2 but using Dispersion D-19 in place of Dispersion D-1. | |
| Example 2-1 - Same as Example 1-2 but using Dispersion A-2 in place of Dispersion A-1. | |
| Example 3-1 - Same as Example 1-2 but using Dispersion A-3 in place of Dispersion A-1. | |
| Example 4-1 - Same as Example 1-2 but using Dispersion A-4 in place of Dispersion A-1. | |
| Example 5-1 - Same as Example 1-2 but using Dispersion A-5 in place of Dispersion A-1. | |
| Example 6-1 - Same as Example 1-2 but using Dispersion A-6 in place of Dispersion A-1. | |
| Example 7-1 - Same as Example 1-2 but using Dispersion A-7 in place of Dispersion A-1. | |
| Example 8-1 - Same as Example 1-2 but using Dispersion A-8 in place of Dispersion A-1. | |
| Example 9-1 - Same as Example 1-2 but using Dispersion A-9 in place of Dispersion A-1. | |
| Example 10-1 - Same as Example 1-2 but using Dispersion C-2 in place of Dispersion C-1. | |
| Example 11-1 - Same as Example 1-2 but using Dispersion C-3 in place of Dispersion C-1. | |
| Example 12-1 - Same as Example 1-2 but using Dispersion C-4 in place of Dispersion C-1. | |
| Example 13-1 - Same as Example 1-2 but using Dispersion B-2 in place of Dispersion B-1. | |
| Example 14-1 - Same as Example 1-2 but using Dispersion B-3 in place of Dispersion B-1. | |
| Example 15-1 - Same as Example 1-2 but using Dispersion B-4 in place of Dispersion B-1. | |

These examples are illustrative and are not intended to be limiting. The chromogenic materials may be mixed and ratios of other materials varied.

The thermal performance of the sheets where checked by contact with a heated metal block for 5 seconds, imaging on a laboratory printer or imaging on commercial facisimile unit. The color produced was measured with a Macbeth RD-514 densitometer, No. 106 visual wratten filter. A low value indicated little color is produced and the higher the value, the more color was produced.

TABLE 1

Thermal Response

I. Stepwedge

| | Temperature °F./Macbeth Reading | | | | | | | | | | |
|---|---|---|---|---|---|---|---|---|---|---|---|
| Example | 300 | 275 | 260 | 245 | 230 | 215 | 200 | 185 | 170 | 155 | 140 |
| Control-1 | 1.41 | 1.44 | 1.45 | 1.46 | 1.44 | 1.39 | 1.31 | 0.66 | 0.08 | 0.03 | 0.03 |
| Example 1-1 | 1.23 | 1.28 | 1.28 | 1.29 | 1.29 | 1.26 | 1.29 | 0.91 | 0.14 | 0.02 | 0.02 |
| Example 1-2 | 1.36 | 1.40 | 1.40 | 1.41 | 1.39 | 1.39 | 1.38 | 1.16 | 0.45 | 0.04 | 0.02 |
| Control-2 | 1.39 | 1.42 | 1.40 | 1.41 | 1.42 | 1.33 | 1.23 | 0.48 | 0.03 | 0.02 | 0.02 |
| Example 2-1 | 1.33 | 1.38 | 1.41 | 1.39 | 1.39 | 1.36 | 1.33 | 1.09 | 0.24 | 0.03 | 0.03 |
| Control-3 | 1.39 | 1.37 | 1.37 | 1.36 | 1.35 | 1.25 | 1.13 | 0.47 | 0.11 | 0.05 | 0.02 |
| Example 3-1 | 1.36 | 1.38 | 1.36 | 1.35 | 1.33 | 1.27 | 1.27 | 0.98 | 0.36 | 0.04 | 0.01 |
| Control-4 | 1.35 | 1.41 | 1.42 | 1.41 | 1.39 | 1.33 | 1.19 | 0.67 | 0.09 | 0.03 | 0.02 |
| Example 4-1 | 1.37 | 1.36 | 1.37 | 1.38 | 1.35 | 1.37 | 1.36 | 1.08 | 0.46 | 0.03 | 0.03 |
| Control-5 | 1.32 | 1.35 | 1.35 | 1.35 | 1.29 | 1.18 | 1.05 | 0.18 | 0.05 | 0.02 | 0.02 |
| Example 5-1 | 1.30 | 1.29 | 1.30 | 1.30 | 1.29 | 1.29 | 1.27 | 0.94 | 0.36 | 0.01 | 0.01 |
| Control-6 | 1.41 | 1.41 | 1.41 | 1.40 | 1.34 | 1.20 | 1.14 | 0.71 | 0.14 | 0.03 | 0.03 |
| Example 6-1 | 1.44 | 1.43 | 1.43 | 1.43 | 1.41 | 1.42 | 1.40 | 1.15 | 0.46 | 0.03 | 0.03 |
| Control-7 | 1.42 | 1.44 | 1.43 | 1.44 | 1.42 | 1.40 | 1.31 | 1.03 | 0.30 | 0.04 | 0.04 |
| Example 7-1 | 1.39 | 1.40 | 1.41 | 1.41 | 1.40 | 1.39 | 1.42 | 1.30 | 0.67 | 0.08 | 0.02 |
| Control-8 | 1.42 | 1.41 | 1.43 | 1.42 | 1.41 | 1.36 | 1.26 | 0.94 | 0.64 | 0.23 | 0.05 |
| Example 8-1 | 1.35 | 1.39 | 1.38 | 1.38 | 1.39 | 1.38 | 1.37 | 1.26 | 1.02 | 0.28 | 0.06 |
| Control-9* | 0.78 | 0.78 | 0.76 | 0.73 | 0.55 | 0.44 | 0.34 | 0.06 | 0.04 | 0.04 | 0.04 |
| Example 9-1* | 1.15 | 1.14 | 1.13 | 1.14 | 1.14 | 1.12 | 1.12 | 0.98 | 0.32 | 0.02 | 0.02 |
| Control-10 | 1.25 | 1.26 | 1.24 | 1.25 | 1.21 | 1.22 | 1.20 | 1.19 | 0.90 | 0.03 | 0.03 |
| Example 10-1 | 1.30 | 1.31 | 1.32 | 1.31 | 1.30 | 1.30 | 1.26 | 1.15 | 0.82 | 0.05 | 0.03 |
| Control-11 | 1.35 | 1.34 | 1.34 | 1.34 | 1.27 | 1.23 | 1.07 | 0.76 | 0.30 | 0.01 | 0.01 |
| Example 11-1 | 1.29 | 1.31 | 1.29 | 1.29 | 1.28 | 1.28 | 1.28 | 1.23 | 0.73 | 0.08 | 0.02 |
| Control-12 | 1.34 | 1.35 | 1.35 | 1.34 | 1.28 | 1.23 | 1.07 | 0.60 | 0.04 | 0.02 | 0.02 |
| Example 12-1 | 1.35 | 1.33 | 1.33 | 1.33 | 1.30 | 1.28 | 1.25 | 0.82 | 0.13 | 0.02 | 0.02 |
| Control-13 | 1.41 | 1.42 | 1.39 | 1.39 | 1.40 | 1.39 | 1.36 | 1.10 | 0.26 | 0.07 | 0.04 |
| Example 13-1 | 1.40 | 1.40 | 1.40 | 1.40 | 1.39 | 1.37 | 1.36 | 1.10 | 0.47 | 0.13 | 0.08 |

TABLE 1-continued

| Thermal Response | | | | | | | | | | | |
|---|---|---|---|---|---|---|---|---|---|---|---|
| Control-14 | 1.43 | 1.44 | 1.45 | 1.43 | 1.41 | 1.43 | 1.42 | 1.17 | 0.69 | 0.20 | 0.18 |
| Example 14-1 | 1.41 | 1.41 | 1.42 | 1.42 | 1.43 | 1.43 | 1.42 | 1.22 | 0.63 | 0.22 | 0.16 |
| Control-15 | 1.39 | 1.38 | 1.39 | 1.39 | 1.38 | 1.38 | 1.38 | 1.36 | 1.30 | 0.33 | 0.10 |
| Example 15-1 | 1.38 | 1.38 | 1.40 | 1.40 | 1.38 | 1.39 | 1.37 | 1.32 | 1.24 | 0.74 | 0.28 |

II. Dynamic Tester (18 Volt)

| | Pulse Time ms/Macbeth Reading | | | | | | | | | |
|---|---|---|---|---|---|---|---|---|---|---|
| Example | 0.5 | 0.7 | 0.9 | 1.1 | 1.3 | 1.5 | 1.7 | 1.9 | 2.1 | 2.3 |
| Control-1 | 0.25 | 0.48 | 0.82 | 1.13 | 1.20 | 1.32 | 1.33 | 1.35 | 1.33 | 1.34 |
| Example 1-1 | 0.07 | 0.25 | 0.52 | 0.71 | 1.07 | 1.23 | 1.25 | 1.26 | 1.28 | 1.30 |
| Example 1-2 | 0.20 | 0.50 | 0.93 | 1.18 | 1.31 | 1.33 | 1.33 | 1.37 | 1.38 | 1.35 |
| Control-2 | 0.19 | 0.45 | 0.76 | 1.05 | 1.25 | 1.29 | 1.37 | 1.35 | 1.36 | 1.36 |
| Example 2-1 | 0.22 | 0.46 | 0.82 | 1.04 | 1.17 | 1.28 | 1.28 | 1.30 | 1.33 | 1.34 |
| Control-3 | 0.17 | 0.39 | 0.75 | 0.95 | 1.13 | 1.27 | 1.27 | 1.30 | 1.35 | 1.33 |
| Example 3-1 | 0.20 | 0.43 | 0.68 | 0.98 | 1.11 | 1.20 | 1.24 | 1.25 | 1.29 | 1.30 |
| Control-4 | 0.23 | 0.47 | 0.93 | 1.26 | 1.33 | 1.33 | 1.34 | 1.35 | 1.36 | 1.36 |
| Example 4-1 | 0.22 | 0.50 | 0.80 | 1.14 | 1.26 | 1.34 | 1.34 | 1.36 | 1.35 | 1.35 |
| Control-5 | 0.17 | 0.42 | 0.86 | 1.04 | 1.21 | 1.23 | 1.22 | 1.24 | 1.24 | 1.29 |
| Example 5-1 | 0.21 | 0.50 | 0.85 | 1.06 | 1.20 | 1.26 | 1.27 | 1.26 | 1.27 | 1.25 |
| Control-6 | 0.13 | 0.35 | 0.62 | 0.88 | 1.12 | 1.19 | 1.23 | 1.27 | 1.30 | 1.31 |
| Example 6-1 | 0.10 | 0.26 | 0.51 | 0.84 | 1.12 | 1.20 | 1.23 | 1.30 | 1.33 | 1.32 |
| Control-7 | 0.30 | 0.59 | 0.97 | 1.26 | 1.36 | 1.39 | 1.41 | 1.42 | 1.42 | 1.43 |
| Example 7-1 | 0.30 | 0.57 | 0.97 | 1.19 | 1.33 | 1.37 | 1.38 | 1.39 | 1.40 | 1.41 |
| Control-8 | 0.37 | 0.68 | 1.03 | 1.32 | 1.37 | 1.40 | 1.42 | 1.41 | 1.41 | 1.40 |
| Example 8-1 | 0.30 | 0.57 | 0.97 | 1.19 | 1.33 | 1.37 | 1.38 | 1.39 | 1.40 | 1.41 |
| Control-10 | 0.18 | 0.39 | 0.64 | 0.88 | 1.13 | 1.22 | 1.26 | 1.26 | 1.26 | 1.26 |
| Example 10-1 | 0.17 | 0.39 | 0.67 | 0.99 | 1.18 | 1.26 | 1.28 | 1.30 | 1.32 | 1.33 |
| Control-11 | 0.19 | 0.45 | 0.80 | 1.09 | 1.25 | 1.30 | 1.31 | 1.31 | 1.32 | 1.33 |
| Example 11-1 | 0.23 | 0.48 | 0.77 | 1.02 | 1.23 | 1.31 | 1.31 | 1.31 | 1.32 | 1.34 |
| Control-12 | 0.13 | 0.36 | 0.57 | 0.85 | 1.10 | 1.21 | 1.25 | 1.28 | 1.28 | 1.30 |
| Example 12-1 | 0.14 | 0.30 | 0.58 | 0.82 | 1.05 | 1.18 | 1.26 | 1.30 | 1.32 | 1.32 |
| Control-13 | 0.24 | 0.49 | 0.85 | 1.06 | 1.23 | 1.32 | 1.33 | 1.34 | 1.33 | 1.34 |
| Example 13-1 | 0.27 | 0.51 | 0.87 | 1.06 | 1.28 | 1.29 | 1.31 | 1.34 | 1.34 | 1.34 |
| Control-14 | 0.34 | 0.60 | 0.98 | 1.22 | 1.30 | 1.34 | 1.36 | 1.37 | 1.38 | 1.38 |
| Example 14-1 | 0.37 | 0.64 | 1.02 | 1.31 | 1.37 | 1.38 | 1.39 | 1.39 | 1.39 | 1.39 |

III. Facsimile (Hi Fax 700)

| | Areas/Macbeth Reading | | | |
|---|---|---|---|---|
| Example | Top | Left | Bottom | Right |
| Control-1 | 1.35 | 1.33 | 1.32 | 1.34 |
| Example 1-1 | 1.24 | 1.24 | 1.24 | 1.18 |
| Example 1-2 | 1.35 | 1.34 | 1.34 | 1.31 |
| Control-2 | 1.31 | 1.31 | 1.28 | 1.25 |
| Example 2-1 | 1.36 | 1.31 | 1.31 | 1.24 |
| Control-3 | 1.20 | 1.23 | 1.24 | 1.17 |
| Example 3-1 | 1.19 | 1.19 | 1.17 | 1.13 |
| Control-4 | 1.35 | 1.31 | 1.32 | 1.30 |
| Example 4-1 | 1.34 | 1.33 | 1.34 | 1.27 |
| Control-5 | 1.27 | 1.27 | 1.29 | 1.25 |
| Example 5-1 | 1.25 | 1.23 | 1.26 | 1.24 |
| Control-6 | 1.20 | 1.20 | 1.26 | 1.24 |
| Example 6-1 | 1.24 | 1.24 | 1.26 | 1.26 |
| Control-7 | 1.37 | 1.39 | 1.38 | 1.40 |
| Example 7-1 | 1.36 | 1.34 | 1.35 | 1.35 |
| Control-8 | 1.38 | 1.41 | 1.40 | 1.40 |
| Example 8-1 | 1.36 | 1.34 | 1.35 | 1.33 |
| Control-10 | 1.23 | 1.23 | 1.23 | 1.21 |
| Example 10-1 | 1.26 | 1.24 | 1.25 | 1.24 |
| Control-11 | 1.31 | 1.29 | 1.29 | 1.29 |
| Example 11-1 | 1.28 | 1.29 | 1.28 | 1.28 |
| Control-12 | 1.24 | 1.23 | 1.27 | 1.23 |
| Example 12-1 | 1.19 | 1.17 | 1.21 | 1.20 |
| Control-13 | 1.34 | 1.32 | 1.33 | 1.31 |
| Example 13-1 | 1.32 | 1.36 | 1.36 | 1.31 |
| Control-14 | 1.39 | 1.38 | 1.35 | 1.36 |
| Example 14-1 | 1.38 | 1.36 | 1.36 | 1.36 |
| Control-15 | 1.38 | 1.34 | 1.38 | 1.35 |
| Example 15-1 | 1.35 | 1.30 | 1.33 | 1.34 |

*Sample has color absorbance beyond the reading limits of the Macbeth RD-514.

The data of Table 1 present a comparison of the thermal responses of thermally responsive recording materials of the invention containing a metal salt of a cinnamic acid and structurally related compounds of formulas (I) and (II) compared to corresponding thermally-responsive recording material in which metal salt of formulas (I) and (II) are omitted. Recording material with the metal salt compounds of formulas (I) and (II) clearly do not detract from the thermal responsiveness of the recording materials. More often the responsiveness is increased. As the tables which follow show, image retention is surprisingly improved.

The resistance to image erasure was checked by placing a fingerprint rich in skin oil on the imaged area. The area was observed and any changes in image quality noted.

The ranking scale for image resistance is 0–4.

0=No change in image quality.
1=Image density reduced but no erasure.
2=Image density reduced and slight erasure.
3=Moderate erasure of image.
4=Complete erasure of image.

The same observations were made using a plastic film, specifically in the case Borden Resenite RMF-61HY. A piece of film larger than the imaged area is placed on the sample and weighted with a flat surface. Cooking oil and internal phase solvent (also referred to as IP solvent) were tested by rubbing a drop of the oil between two finger tips and then pressing on the imaged area.

TABLE 2

Image Resistance

I. Stepwedge - Skin Oil

| Example | Image Temp. °F. | Time of Test (Day) | Result |
|---|---|---|---|
| Control-1 | 300 | 30 | 4 |
| | 170 | 30 | 4 |
| | 300 | 4 | 3 |
| | 170 | 4 | 4 |
| Example 1-1 | 300 | 30 | 1 |
| | 170 | 30 | 4 |
| Example 1-2 | 300 | 30 | 1 |
| | 170 | 30 | 2 |
| Example 1-3 | 300 | 12 | 1 |
| Example 1-4 | 300 | 31 | 1 |
| | 170 | 31 | 2 |
| Example 1-5 | 300 | 31 | 1 |
| | 170 | 31 | 3 |
| Example 1-6 | 300 | 4 | 1 |
| | 170 | 4 | 2 |
| Example 1-7 | 300 | 4 | 1 |
| | 170 | 4 | 1 |
| Example 1-8 | 300 | 4 | 1 |
| | 170 | 4 | 4 |
| Example 1-9 | 300 | 4 | 1 |
| | 170 | 4 | 2 |
| Example 1-10 | 300 | 4 | 1 |
| | 170 | 4 | 4 |
| Example 1-11 | 300 | 4 | 1 |
| | 170 | 4 | 3 |
| Example 1-12 | 300 | 4 | 1 |
| | 170 | 4 | 1 |
| Example 1-13 | 300 | 25 | 2 |
| | 170 | 25 | 3 |
| Example 1-14 | 300 | 25 | 1 |
| | 170 | 25 | 3 |
| Example 1-15 | 300 | 25 | 1 |
| | 170 | 25 | 3 |
| Example 1-16 | 300 | 25 | 1 |
| | 170 | 25 | 3 |
| Example 1-17 | 300 | 25 | 2 |
| | 170 | 25 | 3 |
| Example 1-18 | 300 | 34 | 1 |
| | 170 | 34 | 4 |
| Example 1-19 | 300 | 2 | 1 |
| | 170 | 2 | 2 |
| Example 1-20 | 300 | 2 | 1 |
| | 170 | 2 | 2 |
| Example 1-21 | 300 | 2 | 1 |
| | 170 | 2 | 2 |
| Example 1-22 | 300 | 5 | 1 |
| | 170 | 5 | 2 |
| Example 1-23 | 300 | 2 | 1 |
| | 170 | 2 | 4 |
| Example 1-24 | 300 | 39 | 1 |
| | 170 | 39 | 3 |
| Example 1-25 | 300 | 39 | 1 |
| | 170 | 39 | 2 |
| Control-2 | 300 | 30 | 4 |
| Example 2-1 | 300 | 30 | 2 |
| Control-3 | 300 | 4 | 1 |
| | 185 | 4 | 4 |

TABLE 2-continued

Image Resistance

| | | | |
|---|---|---|---|
| Example 3-1 | 300 | 4 | 1 |
| | 185 | 4 | 1 |
| Control-4 | 300 | 4 | 1 |
| | 185 | 4 | 3 |
| Example 4-1 | 300 | 4 | 1 |
| | 185 | 4 | 1 |
| Control-5 | 300 | 4 | 4 |
| | 200 | 4 | 4 |
| Example 5-1 | 300 | 4 | 1 |
| | 170 | 4 | 4 |
| Control-6 | 300 | 11 | 4 |
| Example 6-1 | 300 | 11 | 2 |
| Control-7 | 300 | 11 | 0 |
| Example 7-1 | 300 | 11 | 1 |
| Control-8 | 300 | 11 | 2 |
| Example 8-1 | 300 | 11 | 1 |
| Control-9 | 300 | 4 | 3 |
| | 200 | 4 | 4 |
| Example 9-1 | 300 | 4 | 1 |
| | 200 | 4 | 1 |
| Control-10 | 300 | 18 | 1 |
| Example 10-1 | 300 | 18 | 1 |
| Control-11 | 300 | 18 | 3 |
| Example 11-1 | 300 | 18 | 1 |
| Control-12 | 300 | 18 | 2 |
| Example 12-1 | 300 | 18 | 1 |
| Control-13 | 300 | 18 | 1 |
| | 170 | 18 | 4 |
| Example 13-1 | 300 | 18 | 1 |
| | 170 | 18 | 3 |
| Control-14 | 300 | 18 | 1 |
| | 170 | 18 | 0 |
| Example 14-1 | 300 | 18 | 1 |
| | 170 | 18 | 0 |
| Control-15 | 300 | 5 | 4 |
| | 170 | 5 | 4 |
| Example 15-1 | 300 | 5 | 1 |
| | 170 | 5 | 1 |

II. Facsimile

| Example | Area of Test | Time (Day) | Result |
|---|---|---|---|
| | A. Skin Oil | | |
| Control-1 | Bottom | 22 | 4 |
| | Bottom | 4 | 4 |
| Example 1-1 | Bottom | 22 | 4 |
| Example 1-2 | Bottom | 30 | 1 |
| Example 1-3 | Bottom | 6 | 1 |
| Example 1-4 | Bottom | 31 | 1 |
| Example 1-5 | Bottom | 31 | 3 |
| Example 1-6 | Bottom | 4 | 1 |
| Example 1-7 | Bottom | 4 | 1 |
| Example 1-8 | Bottom | 4 | 1 |
| Example 1-9 | Bottom | 4 | 1 |
| Example 1-10 | Bottom | 4 | 2 |
| Example 1-11 | Bottom | 4 | 1 |
| Example 1-12 | Bottom | 4 | 1 |
| Example 1-13 | Bottom | 22 | 3 |
| Example 1-14 | Bottom | 22 | 1 |
| Example 1-15 | Bottom | 22 | 1 |
| Example 1-16 | Bottom | 22 | 1 |
| Example 1-17 | Bottom | 22 | 2 |
| Example 1-18 | Bottom | 31 | 1 |
| Example 1-19 | Bottom | 16 | 1 |
| Example 1-20 | Bottom | 16 | 1 |
| Example 1-21 | Bottom | 16 | 4 |
| Example 1-22 | Bottom | 5 | 1 |
| Example 1-23 | Bottom | 16 | 3 |
| Example 1-24 | Bottom | 39 | 2 |
| Example 1-25 | Bottom | 39 | 1 |
| Control-2 | Bottom | 22 | 4 |
| Example 2-1 | Bottom | 30 | 1 |
| Control-3 | Bottom | 3 | 4 |
| Example 3-1 | Bottom | 3 | 1 |
| Control-4 | Bottom | 3 | 2 |
| Example 4-1 | Bottom | 3 | 0 |
| Control-5 | Bottom | 3 | 4 |
| Example 5-1 | Bottom | 3 | 2 |
| Control-6 | Bottom | 11 | 4 |
| Example 6-1 | Bottom | 11 | 1 |

TABLE 2-continued

| Image Resistance | | | |
|---|---|---|---|
| Control-7 | Bottom | 11 | 3 |
| Example 7-1 | Bottom | 11 | 1 |
| Control-8 | Bottom | 11 | 2 |
| Example 8-1 | Bottom | 11 | 0 |
| Control-10 | Bottom | 15 | 3 |
| Example 10-1 | Bottom | 15 | 1 |
| Control-11 | Bottom | 15 | 4 |
| Example 11-1 | Bottom | 15 | 1 |
| Control-12 | Bottom | 15 | 4 |
| Example 12-1 | Bottom | 15 | 2 |
| Control-13 | Bottom | 18 | 1 |
| Example 13-1 | Bottom | 18 | 1 |
| Control-14 | Bottom | 18 | 1 |
| Example 14-1 | Bottom | 18 | 1 |
| Control-15 | Bottom | 5 | 4 |
| Example 15-1 | Bottom | 5 | 1 |
| | B. Plastic Film | | |
| Control-1 | Top | 30 | 4 |
| | | 24 | 4 |
| Example 1-1 | Top | 30 | 2 |
| Example 1-2 | Top | 30 | 1 |
| Example 1-3 | Top | 24 | 3 |
| Example 1-4 | Top | 24 | 1 |
| Example 1-5 | Top | 24 | 4 |
| Example 1-6 | Top | 24 | 2 |
| Example 1-7 | Top | 24 | 1 |
| Example 1-8 | Top | 24 | 1 |
| Example 1-9 | Top | 24 | 3 |
| Example 1-10 | Top | 24 | 2 |
| Example 1-11 | Top | 24 | 2 |
| Example 1-12 | Top | 24 | 1 |
| Example 1-13 | Top | 24 | 2 |
| Example 1-14 | Top | 24 | 1 |
| Example 1-15 | Top | 24 | 2 |
| Example 1-16 | Top | 24 | 1 |
| Example 1-17 | Top | 24 | 3 |
| Example 1-18 | Top | 24 | 2 |
| Example 1-19 | Top | 24 | 1 |
| Example 1-20 | Top | 25 | 1 |
| Example 1-21 | Top | 25 | 2 |
| Example 1-22 | Top | 25 | 2 |
| Example 1-23 | Top | 25 | 2 |
| Example 1-24 | Top | 25 | 3 |
| Example 1-25 | Top | 24 | 3 |
| Control-2 | Top | 30 | 4 |
| Example 2-1 | Top | 30 | 2 |
| Control-3 | Top | 24 | 4 |
| Example 3-1 | Top | 24 | 1 |
| Control-4 | Top | 24 | 3 |
| Example 4-1 | Top | 24 | 1 |
| Control-5 | Top | 24 | 4 |
| Example 5-1 | Top | 24 | 2 |
| Control-6 | Top | 24 | 4 |
| Example 6-1 | Top | 24 | 2 |
| Control 7 | Top | 24 | 3 |
| Example 7-1 | Top | 24 | 2 |
| Control-8 | Top | 24 | 3 |
| Example 8-1 | Top | 24 | 2 |
| Control-10 | Top | 24 | 4 |
| Example 10-1 | Top | 24 | 1 |
| Control-11 | Top | 24 | 4 |
| Example 11-1 | Top | 24 | 1 |
| Control-12 | Top | 24 | 4 |
| Example 12-1 | Top | 24 | 1 |
| Control-13 | Top | 22 | 3 |
| Example 13-1 | Top | 22 | 1 |
| Control-14 | Top | 22 | 1 |
| Example 14-1 | Top | 22 | 1 |
| Control-15 | Top | 24 | 3 |
| Example 15-1 | Top | 24 | 1 |
| | C. Cooking Oil | | |
| Control-1 | Top | 14 | 4 |
| | | 2 | 4 |
| Example 1-2 | Top | 14 | 1 |
| Example 1-3 | Top | 4 | 3 |
| Example 1-4 | Top | 39 | 1 |
| Example 1-5 | Top | 4 | 3 |
| Example 1-6 | Top | 2 | 3 |
| Example 1-7 | Top | 2 | 1 |
| Example 1-8 | Top | 2 | 2 |

TABLE 2-continued

| Image Resistance | | | |
|---|---|---|---|
| Example 1-9 | Top | 2 | 3 |
| Example 1-10 | Top | 2 | 3 |
| Example 1-11 | Top | 2 | 2 |
| Example 1-12 | Top | 2 | 1 |
| Example 1-13 | Top | 25 | 3 |
| Example 1-14 | Top | 25 | 2 |
| Example 1-15 | Top | 25 | 2 |
| Example 1-16 | Top | 25 | 1 |
| Example 1-17 | Top | 25 | 3 |
| Example 1-18 | Top | 31 | 3 |
| Example 1-19 | Top | 16 | 1 |
| Example 1-20 | Top | 16 | 2 |
| Example 1-21 | Top | 16 | 3 |
| Example 1-22 | Top | 5 | 3 |
| Example 1-23 | Top | 16 | 3 |
| Example 1-25 | Top | 4 | 2 |
| Control-2 | Top | 10 | 4 |
| Example 2-1 | Top | 10 | 1 |
| Control-3 | Top | 3 | 4 |
| Example 3-1 | Top | 3 | 1 |
| Control-4 | Top | 3 | 3 |
| Example 4-1 | Top | 3 | 1 |
| Control-5 | Top | 3 | 4 |
| Example 5-1 | Top | 3 | 2 |
| Control-6 | Top | 14 | 4 |
| Example 6-1 | Top | 14 | 2 |
| Control-7 | Top | 14 | 3 |
| Example 7-1 | Top | 14 | 2 |
| Control-8 | Top | 14 | 4 |
| Example 8-1 | Top | 14 | 2 |
| Control-10 | Top | 18 | 4 |
| Example 10-1 | Top | 18 | 1 |
| Control-11 | Top | 18 | 4 |
| Example 11-1 | Top | 18 | 1 |
| Control-12 | Top | 18 | 4 |
| Example 12-1 | Top | 18 | 2 |
| Control-13 | Top | 22 | 1 |
| Example 13-1 | Top | 22 | 1 |
| Control-14 | Top | 22 | 1 |
| Example 14-1 | Top | 22 | 1 |
| Example-15 | Top | 5 | 4 |
| Example 15-1 | Top | 5 | 1 |
| | D. IP Solvent | | |
| Control-1 | Top | 14 | 4 |
| | | 2 | 4 |
| Example 1-2 | Top | 14 | 1 |
| Example 1-3 | Top | 4 | 3 |
| Example 1-4 | Top | 39 | 1 |
| Example 1-5 | Top | 4 | 1 |
| Example 1-6 | Top | 2 | 1 |
| Example 1-7 | Top | 2 | 1 |
| Example 1-8 | Top | 2 | 1 |
| Example 1-9 | Top | 2 | 2 |
| Example 1-10 | Top | 2 | 2 |
| Example 1-11 | Top | 2 | 1 |
| Example 1-12 | Top | 2 | 1 |
| Example 1-13 | Top | 25 | 3 |
| Example 1-14 | Top | 25 | 2 |
| Example 1-15 | Top | 25 | 2 |
| Example 1-16 | Top | 25 | 2 |
| Example 1-17 | Top | 25 | 3 |
| Example 1-18 | Top | 31 | 2 |
| Example 1-19 | Top | 16 | 1 |
| Example 1-20 | Top | 16 | 2 |
| Example 1-21 | Top | 16 | 3 |
| Example 1-22 | Top | 5 | 2 |
| Example 1-23 | Top | 16 | 3 |
| Example 1-25 | Top | 4 | 3 |
| Control-2 | Top | 10 | 4 |
| Example 2-1 | Top | 10 | 1 |
| Control-3 | Top | 3 | 4 |
| Example 3-1 | Top | 3 | 0 |
| Control-4 | Top | 3 | 4 |
| Example 4-1 | Top | 3 | 0 |
| Control-5 | Top | 3 | 4 |
| Example 5-1 | Top | 3 | 1 |
| Control-6 | Top | 14 | 4 |
| Example 6-1 | Top | 14 | 1 |
| Control-7 | Top | 14 | 2 |
| Example 7-1 | Top | 14 | 1 |

TABLE 2-continued

| Image Resistance | | | |
|---|---|---|---|
| Control-8 | Top | 14 | 4 |
| Example 8-1 | Top | 14 | 1 |
| Control-10 | Top | 18 | 2 |
| Example 10-1 | Top | 18 | 1 |
| Control-11 | Top | 18 | 4 |
| Example 11-1 | Top | 18 | 1 |
| Control-12 | Top | 18 | 4 |
| Example 12-1 | Top | 18 | 1 |
| Control-13 | Top | 21 | 0 |
| Example 13-1 | Top | 21 | 2 |
| Control-14 | Top | 21 | 1 |
| Example 14-1 | Top | 21 | 1 |
| Control-15 | Top | 5 | 4 |
| Example 15-1 | Top | 5 | 1 |

From the data of Table 2 it is readily apparent that thermally-sensitive recording materials containing a metal salt of a cinnamic acid and structurally related compounds of formulas (I) and (II) possess improved resistance to image fade compared to corresponding thermally-sensitive recording materials in which the metal salt of a compound of formula (I) or (II) is omitted.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

What is claimed is:

1. A thermally-responsive record material comprising a support member bearing a thermally-sensitive color-forming composition comprising a chromogenic material and an acidic developer material in contiguous relationship, whereby the melting, softening or sublimation of either material produces a change in color by reaction between the two, a metal salt of the compound of the formula

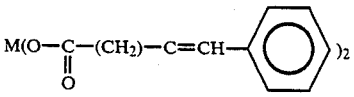

wherein M is a metal selected from Zn, Sn, Ni, Cu, Al, Co, and Mg, and a suitable binder therefor.

2. The thermally-responsive record material of claim 1 wherein the metal salt of the compound of the formula set forth therein is a zinc salt of styrene acetic acid.

3. The record material of claim 1, in which the acidic developer material is a phenol compound.

4. The record material of claim 3 in which the phenol compound is selected from the group consisting of 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)-pentanoate, allyl-4,4-bis(hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, 2,2-bis(4-hydroxyphenyl)-5-methylhexane, benzyl-p-hydroxybenzoate, and mixtures thereof.

5. The record material of claim 3 in which the phenol compound is 2,2-bis(4-hydroxyphenyl)-4-methylpentane.

6. The record material of claim 3 in which the phenol compound is benzyl-p-hydroxybenzoate.

7. The record material of claim 1 wherein in the metal salt of the compound of the formula (I), M is zinc.

8. The record material of claim 1 wherein in the metal salt of the compound of the formula (I), M is calcium.

9. The record material of claim 1 in which the chromogenic material is selected from the group consisting of 3-diethylamino-6-methyl-7-anilinofluoran; 7-(1-ethyl-2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzoypyran]; 3-dibutylamino-6-methyl-7-anilinofluoran; 3-(N-ethyl-N-tetrahydrofurfurylamino)-6-methyl-7-anilinofluoran; 3-dibutylamino-7-(2-chloroanilino)fluoran; 3,3-bis(4-dimethylaminophenyl)-6-dimethylaminophthalide; 7-(1-ethyl-2-methylindol-3-yl)-7-(4-diethylamino-2-ethoxyphenyl)-5,7-dihydrofuro,[3,4-b]pyridine-5-one; 3,5',6-tris(dimethylamino)spiro[9H-fluorene-9,1'(3'H)-isobenzofuran]3'-one, and mixtures thereof.

10. The record material of claim 1 comprising in addition a sensitizer.

11. The record material of claim 10 wherein the sensitizer is selected from 1,2-diphenoxyethane, acetoacet-o-toluedine, p-benzylbiphenyl, and phenyl-1-hydroxy-2-naphthoate.

* * * * *